US008171615B2

(12) United States Patent
Smeyers

(10) Patent No.: US 8,171,615 B2
(45) Date of Patent: May 8, 2012

(54) MACHINE FOR FITTING FASTENERS OF THE RIVET TYPE, PARTICULARLY FOR AIRCRAFT FUSELAGE OR SUBASSEMBLY COMPONENTS

(75) Inventor: Jacques Smeyers, Lanta (FR)

(73) Assignee: Latecis, Sainte-Foy-d'Aigrefeuille (FR)

( * ) Notice: Subject to any disclaimer, the term of this patent is extended or adjusted under 35 U.S.C. 154(b) by 403 days.

(21) Appl. No.: 12/518,168

(22) PCT Filed: Dec. 5, 2007

(86) PCT No.: PCT/IB2007/003765

§ 371 (c)(1),
(2), (4) Date: Jun. 8, 2009

(87) PCT Pub. No.: WO2008/068595

PCT Pub. Date: Jun. 12, 2008

(65) Prior Publication Data

US 2010/0024196 A1 Feb. 4, 2010

(30) Foreign Application Priority Data

Dec. 7, 2006 (FR) ..... 06 10667

(51) Int. Cl.
*B21D 39/00* (2006.01)
*B23B 39/00* (2006.01)

(52) U.S. Cl. ..... 29/524.1; 408/72 R

(58) Field of Classification Search ..... 29/524.1, 29/525.06, 566, 709, 33 K, 243.521; 408/72 R; 442/76; 439/160

See application file for complete search history.

(56) References Cited

U.S. PATENT DOCUMENTS

| | | | | |
|---|---|---|---|---|
| 4,955,119 | A | 9/1990 | Bonomi et al. | |
| 5,042,137 | A | 8/1991 | Speller, Sr. | |
| 5,279,508 | A * | 1/1994 | Lee | 439/660 |
| 6,789,309 | B2 * | 9/2004 | Kondo | 29/709 |
| 7,172,982 | B2 * | 2/2007 | Jaglowski et al. | 442/76 |

OTHER PUBLICATIONS

International Search Report dated Mar. 26, 2008, from corresponding PCT application.

* cited by examiner

*Primary Examiner* — John C Hong
(74) *Attorney, Agent, or Firm* — Young & Thompson

(57) ABSTRACT

In this machine the displacement assembly allows the working head to be moved in five or six axes, namely three translational movements along the three Cartesian axes X, Y and Z, and two or three pivoting options; the working head includes several tools for performing the various operations involved in fitting a fastener, particularly a drilling tool, a countersinking tool; these tools can each be moved in turn between a rest position and working position situated on the working axis; in this working position, each tool can move translationally along the working axis; the working head also includes a bearing piece mounted on it intended to come to bear against the components that are to be assembled and including a buffer region with which the drilling and countersinking tools come into contact as they move, this contact determining the fully deployed position of these tools.

15 Claims, 4 Drawing Sheets

MACHINE FOR FITTING FASTENERS OF THE RIVET TYPE, PARTICULARLY FOR AIRCRAFT FUSELAGE OR SUBASSEMBLY COMPONENTS

The present invention relates to a machine for fitting fasteners of the rivet type, particularly for aircraft fuselage or subassembly components. This machine may in particular drill, countersink and coat with curable compound the holes that will accept the rivets used to assemble aeroplane fuselage panels and fit these rivets. It may also be used for machining operations, particularly for routing out an aeroplane fuselage panel.

The invention also relates to a method for fitting fasteners of the rivet type, particularly for aircraft fuselage or subassembly components, which uses the machine in question.

Fitting the rivets used to assemble aeroplane fuselage panels is a particularly critical operation because it entails not only producing a strong assembly under the best possible conditions but also obtaining a rivet that lies flush with the surrounding surface of the external panel in order to obtain aerodynamics that remain as good as possible.

In the aeronautical industry it is known practice for riveting operations for assembling aircraft fuselage or subassembly components to be done manually, especially since the size of the components to be assembled is large. These manual operations make it possible to obtain a high quality assembly and good aerodynamics but have the significant disadvantage of requiring a great deal of skilled labor and of being slow to the point where the requirements of the modern aeronautical industry can no longer be met.

In this same application, it is also known practice to use riveting machines. However, these machines either have a limited radius of action or are devoted to a single type of assembly, thereby limiting their flexibility.

There have been moves to use so-called "yomping" robots which have the disadvantage of being able to process only certain areas of a fuselage and not the lateral and lower regions thereof and, in general, of not being of very great practical use.

It is also known practice to use manipulator robots of the "multi-jointed" type equipped with a working head at the free end of the arm. This head is in the form of a barrel able to position the various tools for performing the various operations involved in fitting a rivet each in turn. However, these robots have the disadvantage of having a limited radius of action, of having a relatively complicated structure, of having positional accuracy that is adversely effected by the combined play in the various successive joints that they comprise, or of requiring complex computational procedures in order to get around this imprecision, and of needing a great deal of maintenance.

It is an object of the present invention to remedy the various abovementioned disadvantages of the known machines and methods.

The prime objective of the present invention is therefore to provide a machine for fitting fasteners of the rivet type, particularly for aircraft fuselage or subassembly components, which is able to work over a wide radius of action, with high precision both with regard to the positioning of the site at which the fasteners are to be fitted and with regard to the actual execution of the task of fitting these fasteners and, in particular, with regard to producing the countersinks that will accept the heads of the fasteners.

Another objective of the invention is to provide a machine that retains a relatively simple structure and does not require excessively burdensome maintenance operations.

The machine in question comprises, in a way known per se, a working head and a displacement assembly for moving this working head.

According to the invention,

- the displacement assembly allows the working head to be moved in five or six axes, namely three translational movements along the three Cartesian axes X, Y and Z, and two or three pivoting options, this displacement assembly comprising a beam parallel to the Z-axis, at the end of which beam the said working head is mounted with the said two or three pivoting options: the displacement assembly thus allows the working head to be positioned along a working axis that corresponds to the axis for fitting a fastener;
- the working head comprises several tools for performing the various operations involved in fitting a fastener, particularly a drilling tool, a countersinking tool and a tool for actually fitting the fastener; these tools can each be moved in turn between a rest position and working position situated on the said working axis; in this working position, each tool can move translationally along the working axis, between a retracted standby position and a deployed position; the working head also comprises a bearing piece mounted on the working head and able to move translationally with respect to this working head along the working axis; this bearing piece is intended to come to bear against the components that are to be assembled and comprises a buffer region with which the drilling and countersinking tools come into contact as they move from their retracted positions into their deployed positions, this contact determining the fully deployed position of these tools.

The machine according to the invention thus comprises a displacement assembly that has a rigid structure and in particular is devoid of multiple joints that introduce inaccuracies into the positioning of the working head. This displacement assembly allows the working head to be moved over a broad radius of action, particularly along the assembly on one lateral side of a section of aeroplane fuselage, and allows this working head to be positioned along the said working axis, at right angles to the components that are to be assembled. Once the working head is in position, the said bearing piece is moved translationally until it comes into contact with the components that are to be assembled and exerts pressure on them; this pressure pushes the components that are to be assembled against each other and therefore prevents any dust or chips resulting from the drilling and countersinking operations from becoming trapped between these components.

The buffer region that the bearing piece comprises allows the fully deployed position of the drilling and countersinking tools to be defined precisely with respect to the components that are to be assembled, in a way that, is purely mechanical, so that the drilling and countersinking depth is defined in a simple and perfectly precise way at any point in the radius of action of the machine.

This machine can thus, by virtue of its displacement assembly, cover a broad radius of action while at the same time having high precision with regard to the depth of the drillings and countersinks intended to accept the fasteners. This machine also has a relatively simple structure that does not involve burdensome maintenance operations.

As a preference, the said bearing piece comprises a ring secured to it, through which the drilling and countersinking tools pass in their movements into their working positions, this ring comprising the said buffer region and each drilling and countersinking tool comprising a complementary buffer region that comes into contact with the buffer region of the ring during its movement into the deployed position.

The buffer region of the ring may in particular consist of a crossmember extending across the ring.

The ring may advantageously comprise ducts opening onto its internal peripheral face and/or onto its face facing towards the components that are to be assembled, of which at least one duct is connected to an air suction source and of which at least another duct is connected to an air blowing source.

Thus, using a cyclone principle, the ring is able to remove dust and chips resulting from the drilling and/or countersinking in the best possible way, and to clean the working area by blowing air.

Advantageously, the working head comprises a coating unit for coating the holes that will accept the fasteners with curable fixing and/or sealing compound.

The working head advantageously also comprises a camera that can be brought onto the said working axis, this camera being connected to an image analysis unit so that the effectiveness with which a hole is being coated with said curable compound can be detected.

As a preference, the working head comprises a support plate on which the various tools that it comprises are mounted side by side, this support plate being moveable translationally so as to allow the various tools, and the said camera when it comprises one, to be brought in turn into the working position.

By virtue of this translationally mobile mounting plate, the working head retains a relatively simple structure.

The method according to the invention comprises the steps consisting in:

- using a machine as aforementioned;
- bringing the said bearing piece up to bear against the components that are to be assembled;
- drilling and countersinking a hole to accept a fastener by bringing drilling and countersinking tools into abutment against the said buffer region, then fitting the fastener, these two operations being performed without relaxing the pressure exerted by the said bearing piece on the components that are to be assembled.

This method thus makes it possible in an effective way to prevent any ingress between the components that are to be assembled of dust or chips resulting from the drilling, the drilling depth and countersink depth both being perfectly controlled.

As a preference, the method comprises the steps consisting in:

- using a machine the working head of which is further equipped with a coating unit for coating the holes which accept the fasteners with curable fixing and/or sealing compound;
- bringing the said bearing piece up to bear against the components that are to be assembled;
- once a hole for accepting a fastener has been drilled and countersunk but before the fastener is fitted, depositing some curable compound in this hole using the said coating unit, without relaxing the pressure exerted by the said bearing piece on the components that are to be assembled.

The method thus makes it possible also in an effective way to prevent any ingress of curable compound between the components that are to be assembled.

As a preference, the method involves, after depositing the curable compound in the said hole, the step that consists in bringing a camera up to face the hole, this camera being connected to an image analysis unit so that the effectiveness with which a hole is being coated with said curable compound can be detected.

The invention will be better understood and other features and advantages thereof will become apparent with reference to the attached diagrammatic drawing which, by way of non-limiting example, depicts one preferred embodiment of the machine to which it relates.

Figure 4:
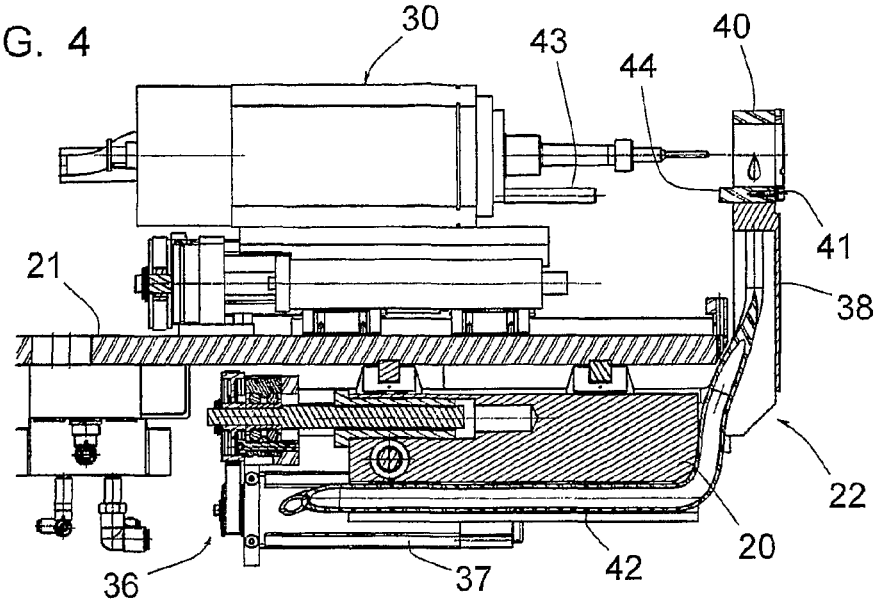
Figure 5:
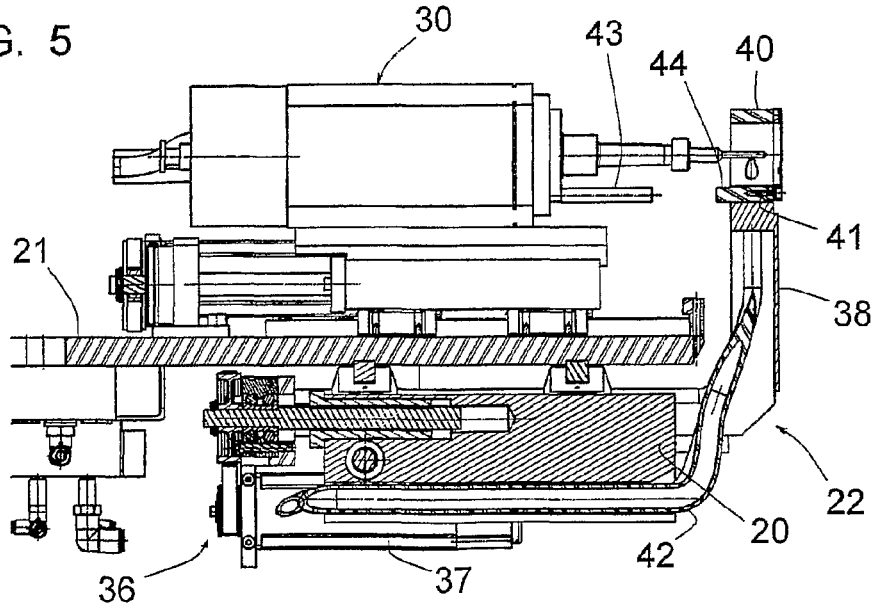
Figure 6:
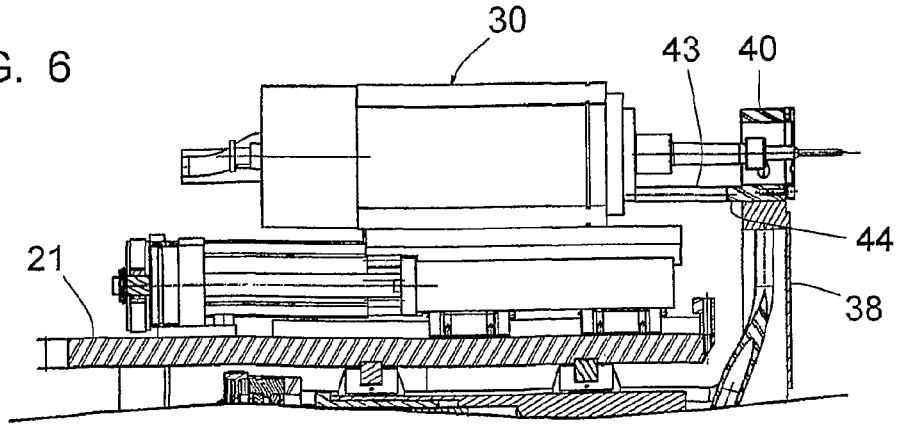
Figure 7:
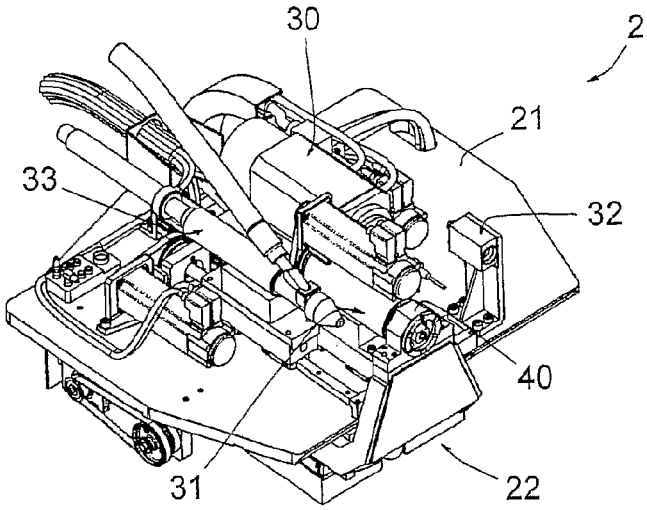
Figure 8:
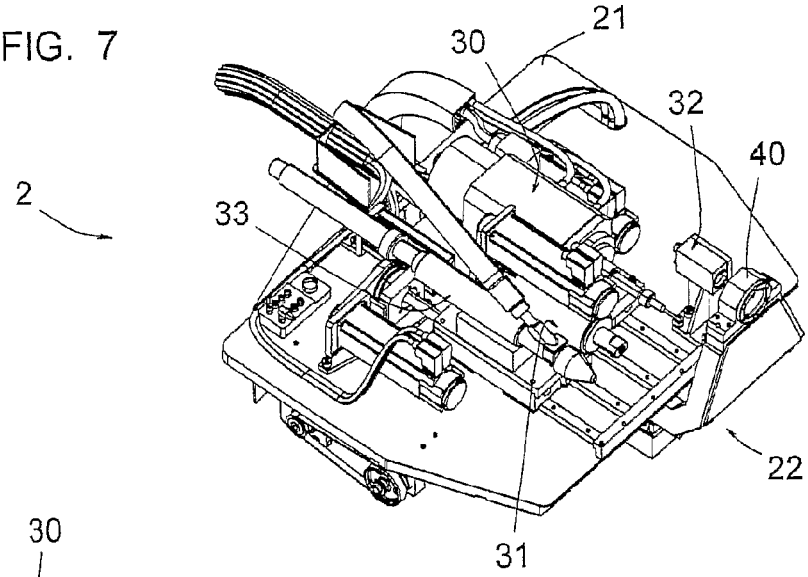
Figure 9:
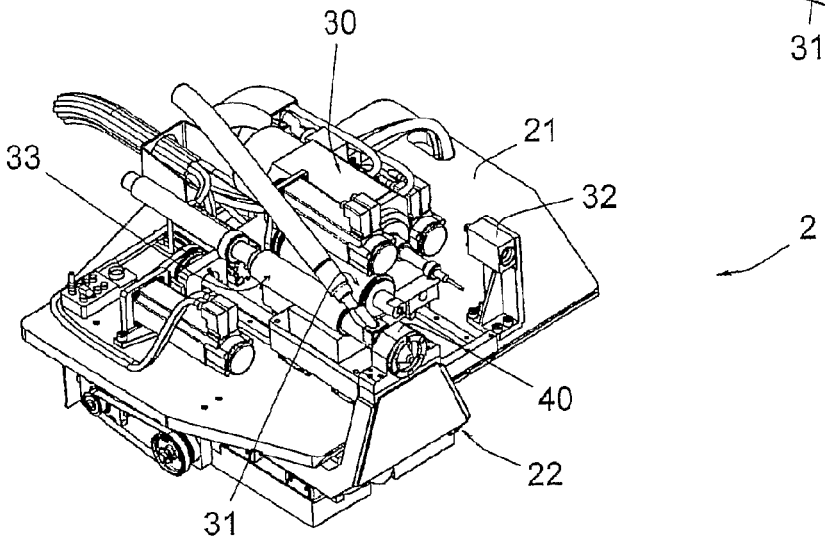

FIGS. 4 to 6 are views in cross section of the working head, on a plane containing a working axis of the various tools that this working head comprises, in three successive positions that a drilling tool adopts during an operation of drilling a hole; and FIGS. 7 to 9 are perspective views of the working head during, respectively, successive operations of coating a hole with curable compound, of detecting the effectiveness with which a hole has been coated with this curable compound, and of actually fitting a fastener.

Figure 1:
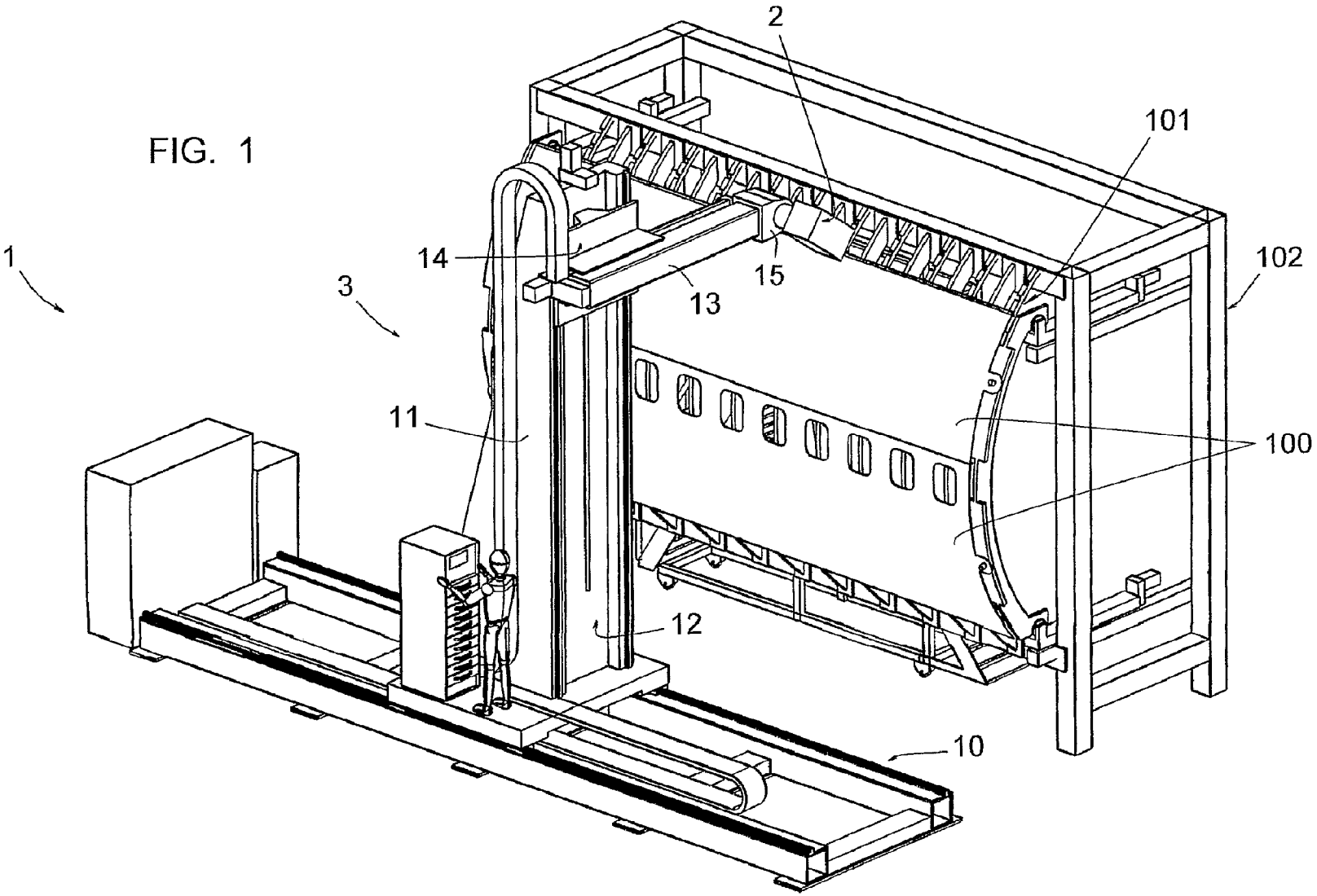
FIG. 1 is a perspective view thereof.

FIG. 1 depicts a machine 1 for fitting fasteners of the rivet type, for assembling the panels 100 of an aeroplane fuselage. A section 101 of this fuselage is in the process of being built on an appropriate support structure 102.

The machine 1 comprises a working head 2 capable of drilling, countersinking and coating with curable compound the holes that will accept the fasteners, and able to fit these fasteners. It also comprises a displacement assembly 3 for moving this working head 2.

As shown by FIG. 1, the displacement assembly 3 comprises:

- a bottom rail 10, the axis of which runs parallel to the axis of the portion of fuselage 101 to be assembled,
- a vertical post 11 mounted to slide on the rail 10, which forms a slideway 12 the axis of which is perpendicular to the axis of the rail 10,
- a horizontal beam 13 the axis of which is perpendicular to the axis of the rail 10 and to the axis of the slideway 12, which is mounted to slide along its longitudinal axis on a support 14 that slides in the slideway 12, and
- between the working head 2 and the corresponding end of the beam 13, a joint 15 giving this head 2 mobility about two axes which are mutually perpendicular and perpendicular to the longitudinal axis of the beam 13.

The displacement assembly 3 therefore allows the working head 2 to be moved in five axes, namely three translational displacements along the three Cartesian axes X, Y and Z (these being the axis of the rail 10, the axis of the slideway 12, and the axis of the beam 13, respectively), and two options for pivoting about two axes that are mutually perpendicular and perpendicular to the Z-axis (joint 15). The working head 2 can be moved along an entire lateral side of the section of fuselage 101 to be assembled, and the joint 15 allows the position of this working head 2 to be adapted to suit the curvature of the fuselage, even in the tapering or rounded portions that a fuselage has near its nose and its tail. The working head 2 can thus always be positioned perpendicular to the panels 100 that are to be assembled, along a working axis that corresponds to the axis of the fastener that is to be fitted.

Figure 2:
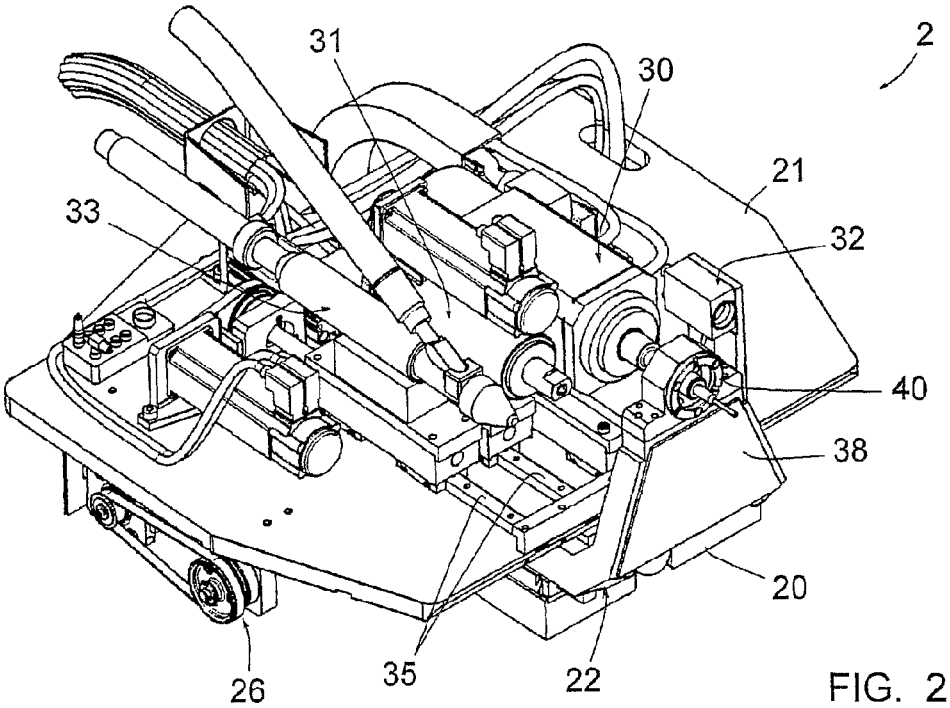
FIG. 2 is a perspective view of the working head that this machine comprises.
Figure 3:
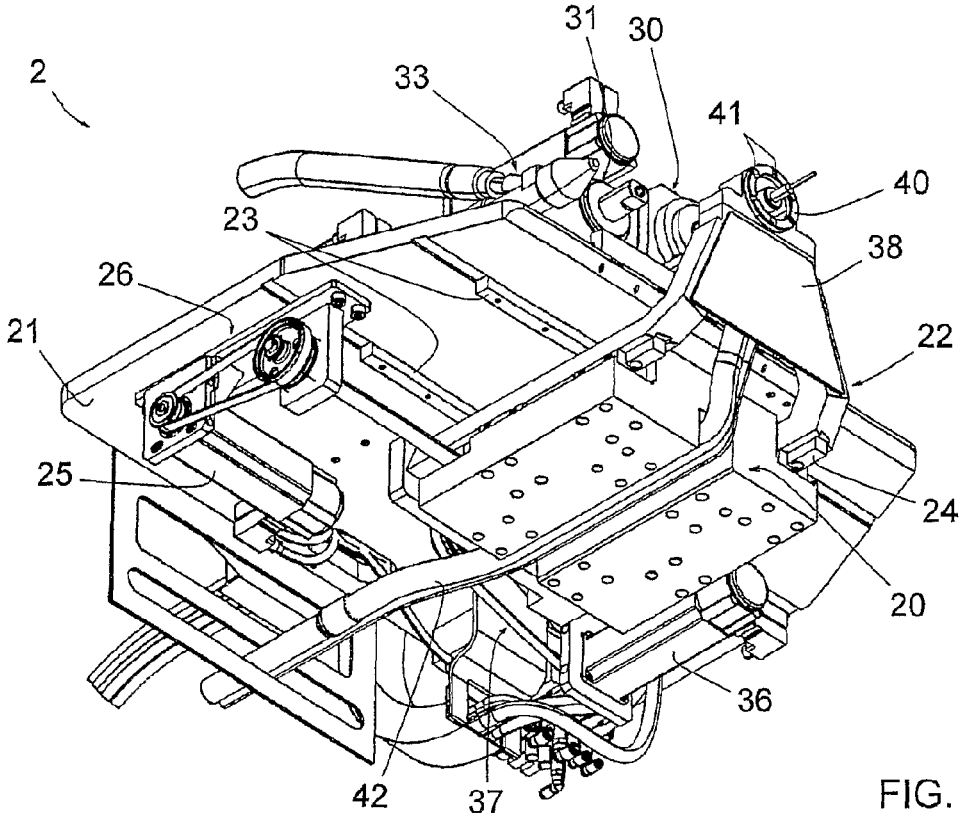
FIG. 3 is a perspective view of this head from another angle.

The working head 2 is more particularly visible in FIGS. 2 and 3, a hood that it comprises not being depicted.

It comprises a mount 20 via which it is rigidly connected to the joint 15, a support plate 21 on which the various tools that it comprises are mounted side by side, and a piece 22 intended to come to bear against the panels 100.

As shown by FIG. 3, the mount 20 comprises a central unit forming a slideway the axis of which is perpendicular to the working axis of the tools, in which slideway the support plate 21 can move via guides 23 that this plate comprises. The mount 20 also comprises two lateral extensions which together form a slideway the axis of which is parallel to the working axis of the tools, and in which the bearing piece 22 moves, also by virtue of guides 24 that this bearing piece comprises.

The support plate 21 is moved perpendicular to the working axis of the tools by means of a motor 25 and a transmission 26. This allows each tool 30 to 33 to be brought in turn into the work position, facing a ring 40 secured to the bearing piece 22.

FIG. 2 more specifically shows the various tools that the plate 21 has, namely a tool 30 for drilling the hole that will accept the fastener and for suitably countersinking this hole so that the fastener lies flush with the surface of the panel 100 on the outside, a unit 31 for coating the hole with a curable fixing and/or sealing compound, a camera 32 to detect the effectiveness with which the hole is being coated with the said curable compound, and a tool 33 for actually fitting the fastener. These various tools are known per se and are therefore not specifically described, and the same goes for their actuating means.

The support plate 21 comprises guides 35 forming slideways which are side by side and parallel to the working axis of the tools, and the tools 30, 31 and 33 are mounted on supports that can slide along these guides 30, these tools being moved using actuators or motors. Each tool 30, 31 and 33 can therefore slide along the working axis, between a retracted standby position (cf. FIG. 2 and FIG. 4 in respect of the tool 30) and a deployed working position in which each tool can pass through the ring 40 (cf. FIGS. 5 and 6 in respect of the tool 30).

The bearing piece 22 can move between a retracted position against the working head 2, visible in FIGS. 2 to 4, and a position in which it bears against the panels 100, visible in FIGS. 5 and 6. This mobility is achieved by means of a motor 36 and a transmission 37. The bearing piece 22 comprises a flat wall 38 for bearing against the panels 100, surmounted by the aforementioned ring 40, the anterior axial face of this ring lying in the same plane as the wall 38 and also bearing against the panels 100.

As shown in FIGS. 2 to 5, the ring 40 comprises ducts 41 opening into radial cups formed on its anterior axial face, at least one of these ducts 41 being connected to an air suction source and at least another of these ducts 41 being connected to an air blowing source, via flexible ducts 42. The ring 40 also comprises a projection 44 forming a buffer region with which the tool 30 comes into contact in its movement into its deployed position, via a corresponding buffer region 43 secured to it, this contact determining the fully deployed position depicted in FIG. 6.

In practice, the displacement assembly 3 positions the working head 2 appropriately to the panels 100 then the bearing piece 22 is brought up to bear against the panels 100. This contact allows pressure to be exerted on the panels 100 to prevent any dust or chips resulting from the drilling and countersinking operations from infiltrating between these panels.

The drilling and countersinking tool 30 is then moved into its deployed work position (FIG. 5) and drills and countersinks the panels 100 until such point as the buffer region 43 it comprises comes into contact with the projection 44 (FIG. 6). This contact, in a purely mechanical and precise manner, determines the fully deployed position of this tool 25 and therefore the depth of the countersink made by this tool.

During these drilling and countersinking operations, air is sucked through the ducts 41 of the ring 40 to set aside any risk of dust or chips being present in the region of the hole.

The tool 30 is then retracted and the support plate 21 is moved to bring the tool 31 to face the ring 40 then the hole is coated with curable compound using this tool 31 (cf. FIG. 7).

The camera 32 is then in turn brought into the working position (cf. FIG. 8) in order, using an image analysis unit to which this camera 32 is connected, to detect how effectively the hole has been coated with the said curable compound.

The tool 33 is then in turn brought into the working position (cf. FIG. 9) to fit the fastener.

During the operations performed by the tools 30 to 33, the pressure on the panels 100 is maintained in order to guarantee the precision of the positioning within the sequence of operations and thus ensure perfect assembly using the fastener.

As is evident from the foregoing, the invention provides a machine for fitting fasteners of the rivet type, particularly for aircraft fuselage or subassembly components, and a method for fitting these fasteners which overcome the disadvantages of the machines and methods of the prior art. In particular, the displacement assembly has a rigid structure and allows the working head to be moved over a wide radius of action, with high precision. The working head is able precisely to define the fully deployed position of the various tools with respect to the components that are to be assembled, in a way that is purely mechanical, which means that the countersinking depth is defined in a simple and perfectly precise way, at any point in the radius of action of the machine, and all the operations can be performed with the panels under pressure, resulting in perfect assembly, as indicated hereinabove. Furthermore, the machine has a relatively simple structure that does not require burdensome maintenance operations.

It goes without saying that the invention is not restricted to the embodiment described hereinabove by way of example but that it encompasses all embodiments covered by the attached claims.

The invention claimed is:

1. Machine (1) for fitting fasteners of the rivet type, onto aircraft fuselage or subassembly components (100), comprising a working head (2) and a displacement assembly (3) for moving this working head (2), characterized in that:

the displacement assembly (3) allows the working head (2) to be moved in five or six axes, namely three translational movements along the three Cartesian axes X, Y and Z, and two or three pivoting options, this displacement assembly (3) comprising a beam (3) parallel to the Z-axis, at the end of which beam the said working head (2) is mounted with the said two or three pivoting options: the displacement assembly (3) thus allows the working head (2) to be positioned along a working axis that corresponds to the axis for fitting a fastener;

the working head (2) comprises several tools (30, 33) for performing the various operations involved in fitting a fastener, the several tools including a drilling tool (30), a countersinking tool (30) and a tool (33) for actually fitting the fastener; these tools (30, 33) can each be moved in turn between a rest position and working position situated on the said working axis; in this working position, each tool (30, 33) can move translationally along the working axis, between a retracted standby position and a deployed position; the working head (2) also comprises a bearing piece (22) mounted on the working head (2) and able to move translationally with respect to this working head (2) along the working axis; this bearing piece (22) is intended to come to bear against the components (100) that are to be assembled and comprises a buffer region (44) with which the drilling and countersinking tools (30) come into contact as they move from their retracted positions into their deployed positions, this contact determining the fully deployed position of these tools (30).

2. Machine (1) according to claim 1, characterized in that the said bearing piece (22) comprises a ring (40) secured to it, through which the drilling and countersinking tools (30) pass in their movements into their working positions, this ring (40) comprising the said buffer region (44) and each drilling and countersinking tool (30) comprises a complementary buffer region (43) that comes into contact with the buffer region (44) of the ring (40) during its movement into the deployed position.

3. Machine (1) according to claim 2, characterized in that the ring (40) has ducts (41) opening onto its internal peripheral face and/or onto its face facing towards the components (100) that are to be assembled, of which at least one duct is connected to an air suction source and of which at least another duct is connected to an air blowing source.

4. Machine (1) according to claim 3, characterized in that the working head (2) comprises a coating unit (31) for coating the holes that will accept the fasteners with curable fixing and/or sealing compound.

5. Machine (1) according to claim 2, characterized in that the working head (2) comprises a support plate (21) on which the various tools (30 to 33) that it comprises are mounted side by side, this support plate (21) being moveable translationally so as to allow the various tools (30 to 33), and the said camera (32) when it comprises one, to be brought in turn into the working position.

6. Machine (1) according to claim 2, characterized in that the working head (2) comprises a coating unit (31) for coating the holes that will accept the fasteners with curable fixing and/or sealing compound.

7. Machine (1) according to claim 3, characterized in that the working head (2) comprises a support plate (21) on which the various tools (30 to 33) that it comprises are mounted side by side, this support plate (21) being moveable translationally so as to allow the various tools (30 to 33), and the said camera (32) when it comprises one, to be brought in turn into the working position.

8. Machine (1) according to claim 1, characterized in that the working head (2) comprises a coating unit (31) for coating the holes that will accept the fasteners with curable fixing and/or sealing compound.

9. Machine (1) according to claim 8, characterized in that the working head (2) comprises a camera (32) that can be brought onto the said working axis, this camera (32) being connected to an image analysis unit so that the effectiveness with which a hole is being coated with said curable compound can be detected.

10. Machine (1) according to claim 9, characterized in that the working head (2) comprises a support plate (21) on which the various tools (30 to 33) that it comprises are mounted side by side, this support plate (21) being moveable translationally so as to allow the various tools (30 to 33), and the said camera (32) when it comprises one, to be brought in turn into the working position.

11. Machine (1) according to claim 1, characterized in that the working head (2) comprises a support plate (21) on which the various tools (30 to 33) that it comprises are mounted side by side, this support plate (21) being moveable translationally so as to allow the various tools (30 to 33), and the said camera (32) when it comprises one, to be brought in turn into the working position.)

12. Machine (1) according to claim 8, characterized in that the working head (2) comprises a support plate (21) on which the various tools (30 to 33) that it comprises are mounted side by side, this support plate (21) being moveable translationally so as to allow the various tools (30 to 33), and the said camera (32) when it comprises one, to be brought in turn into the working position.

13. Method for fitting fasteners of the rivet type onto aircraft fuselage or subassembly components (100), characterized in that it comprises:

using a machine (1) according to claim 1;

bringing the said bearing piece (22) up to bear against the components (100) that are to be assembled;

drilling and countersinking a hole to accept a fastener by bringing drilling and countersinking tools (30) into abutment against the said buffer region (44), then fitting the fastener, these two operations being performed without relaxing the pressure exerted by the said bearing piece (22) on the components (100) that are to be assembled.

14. Method according to claim 13, characterized in that it comprises the steps consisting in:

using a machine (1) the working head (2) of which is further equipped with a coating unit (31) for coating the holes which accept the fasteners with curable fixing and/or sealing compound;

bringing the said bearing piece (22) up to bear against the components (100) that are to be assembled;

once a hole for accepting a fastener has been drilled and countersunk but before the fastener is fitted, depositing some curable compound in this hole using the said coating unit (31), without relaxing the pressure exerted by the said bearing piece (22) on the components (100) that are to be assembled.

15. Method according to claim 14, characterized in that it involves, after depositing the curable compound in the said hole, the step that consists in bringing a camera (32) up to face the hole, this camera (32) being connected to an image analysis unit so that the effectiveness with which a hole is being coated with said curable compound can be detected.

* * * * *